US012331456B2

(12) United States Patent
Aita

(10) Patent No.: US 12,331,456 B2
(45) Date of Patent: Jun. 17, 2025

(54) METHOD FOR PROCESSING RECYCLED CELLULOSE FIBERS, AND PROCESSED RECYCLED CELLULOSE FIBERS

(71) Applicant: TOHOKU SEIREN Co., Ltd., Yonezawa (JP)

(72) Inventor: Hidemi Aita, Yonezawa (JP)

(73) Assignee: TOHOKU SEIREN CO., LTD., Yonezawa (JP)

( * ) Notice: Subject to any disclaimer, the term of this patent is extended or adjusted under 35 U.S.C. 154(b) by 222 days.

(21) Appl. No.: 17/759,383

(22) PCT Filed: Jan. 23, 2021

(86) PCT No.: PCT/JP2021/002351
§ 371 (c)(1),
(2) Date: Jul. 25, 2022

(87) PCT Pub. No.: WO2021/149826
PCT Pub. Date: Jul. 29, 2021

(65) Prior Publication Data

US 2023/0340722 A1 Oct. 26, 2023

(30) Foreign Application Priority Data

Jan. 25, 2020 (JP) ..... 2020-010451

(51) Int. Cl.

| | |
|---|---|
| ***D06M 15/05*** | (2006.01) |
| ***D01F 2/04*** | (2006.01) |
| ***D03D 15/225*** | (2021.01) |
| ***D03D 15/283*** | (2021.01) |

(Continued)

(52) U.S. Cl.
CPC ..... *D06M 15/05* (2013.01); *D01F 2/04* (2013.01); *D03D 15/225* (2021.01); *D03D 15/283* (2021.01); *D06B 3/02* (2013.01); *D06M 2101/06* (2013.01); *D06M 2200/45* (2013.01); *D10B 2331/04* (2013.01); *D10B 2401/063* (2013.01)

(58) Field of Classification Search
None
See application file for complete search history.

(56) References Cited

U.S. PATENT DOCUMENTS

| | | | |
|---|---|---|---|
| 4,475,917 | A | 10/1984 | Ohshima et al. |
| 4,634,470 | A | 1/1987 | Kamide et al. |

(Continued)

FOREIGN PATENT DOCUMENTS

| | | | |
|---|---|---|---|
| CN | 103396572 | A | 11/2013 |
| CN | 107476097 | A | 12/2017 |
| GB | 673642 | A | 6/1952 |

(Continued)

OTHER PUBLICATIONS

Machine translation of JP2019070201 (Year: 2019).*

(Continued)

*Primary Examiner* — Shawn McKinnon
(74) *Attorney, Agent, or Firm* — Banner & Witcoff, Ltd.

(57) ABSTRACT

The present invention provides recycled cellulose-based fibers dimensionally stabilized by the reduction of shrinkage after washing in water or the like. The recycled cellulose fibers have an adsorbate on a surface thereof, in which the adsorbate contains cellulose nanofibers.

4 Claims, 3 Drawing Sheets

(51) Int. Cl.
*D06B 3/02* (2006.01)
*D06M 101/06* (2006.01)

(56) References Cited

U.S. PATENT DOCUMENTS

| | | | | |
|---|---|---|---|---|
| 2014/0130710 | A1 | 5/2014 | Laukkanen et al. | |
| 2014/0166572 | A1* | 6/2014 | Snyder | B01D 39/18 210/507 |

FOREIGN PATENT DOCUMENTS

| | | | |
|---|---|---|---|
| JP | 60139873 | A | 7/1985 |
| JP | H1037067 | A | 2/1998 |
| JP | 2000136484 | A | 5/2000 |
| JP | 2005113333 | A | 4/2005 |
| JP | 2008001728 | A | 1/2008 |
| JP | 2009001941 | A | 1/2009 |
| JP | 2011006808 | A | 1/2011 |
| JP | 2012001830 | A | 1/2012 |
| JP | 2015-040365 | A | 3/2015 |
| JP | 2017-193793 | A | 10/2017 |
| JP | 2017-222786 | A | 12/2017 |
| JP | 2018086203 | A | 6/2018 |
| JP | 2018-153737 | A | 10/2018 |
| JP | 2018-168505 | A | 11/2018 |
| JP | 2018-168506 | A | 11/2018 |
| JP | 2019-070201 | A | 5/2019 |
| JP | 2019-112731 | A | 7/2019 |
| JP | 2019-535920 | A | 12/2019 |
| JP | 2020-128610 | A | 8/2020 |
| JP | 2021050437 | A | 4/2021 |
| WO | 2007088974 | A1 | 8/2007 |
| WO | 2015037658 | A1 | 3/2015 |
| WO | 2018094179 | A1 | 5/2018 |
| WO | 2018116500 | A1 | 6/2018 |
| WO | 2019131588 | A1 | 7/2019 |

OTHER PUBLICATIONS

Mar. 27, 2024 (JP)—Notice of Reasons for Rejection, with English translation—App. No. 2020-010451, 9 pages.
May 10, 2024 (CN) Office Action, with English translation—App. No. 202180010774.01, 31 pages.
Apr. 6, 2021—(WO) International Search Report with translation—App PCT/JP2021/002351.
Nov. 30, 2023 (CN)—Office Action with Search Report (including English translation of search Report)—App. No. 202180010774.0, 11 pages.
Oct. 13, 2024 (CN) Final Rejection App. No. 202180010774.0, with English translation, 32 pages.
Sep. 24, 2024, Yuan Kuan Luo Edited, Textile Merchandising, Textile Merchandising From Fibers, Yarns, and Fabrics to Clothing, Third Edition, Donghua University Press, 7 pages.
Apr. 19, 2025 (CN) Third Office Action with English machine translation, App. 202180010774.0, 18 pages.

* cited by examiner

METHOD FOR PROCESSING RECYCLED CELLULOSE FIBERS, AND PROCESSED RECYCLED CELLULOSE FIBERS

CROSS-REFERENCE TO RELATED APPLICATIONS

This application is a U.S. National Stage application under 35 U.S.C. § 371 of International Application PCT/JP2021/002351 (published as WO/2021/149826 A1), filed Jan. 23, 2021, which claims the benefit of priority to Application JP 2020-010451, filed Jan. 25, 2020. Benefit of the filing date of these prior applications is hereby claimed. Each of these prior applications is hereby incorporated by reference in its entirety.

TECHNICAL FIELD

The present invention relates to a processing method for dimensionally stabilizing recycled cellulose fibers obtained by spinning of recycled cellulose or the like, recycled cellulose fibers processed by the processing method, and a woven or knitted fabric containing recycled cellulose fibers.

Priority is claimed on Japanese Patent Application No. 2020-10451, filed Jan. 25, 2020, the content of which is incorporated herein by reference.

BACKGROUND ART

Owing to their unique drapability, the texture or luster peculiar to cellulose filaments, and sleekness, recycled cellulose-based fibers, such as rayon, polynosic, cupra, lyocell, and acetate, are used for various uses, such as a fabric for ladies' dresses, stoles, a lining for men's and ladies' dresses, curtains, handicraft threads, wrapping cloths, bags, and footwear. The recycled cellulose-based fibers are also widely used for underwears by exploiting the heat retaining properties or hygroscopicity that the fibers exhibit. In recent years, the recycled cellulose-based fibers have been increasingly used for functional underwears and the like that exploit the hygroscopic exothermic effect brought about when moisture is adsorbed onto the surface of the fibers.

Incidentally, the recycled cellulose-based fibers are known to have characteristics in that owing to their high hygroscopicity, the recycled cellulose-based fibers absorb water and swell when immersed in water for washing in water or the like and go through reduction of fiber length when dried after swelling. Therefore, unfortunately, fabrics using the recycled cellulose-based fibers are generally difficult to wash in water and need to be washed by dry cleaning.

The aforementioned swellability that the recycled cellulose-based fibers exhibit or the accompanying phenomenon of fiber length reduction is considered to result from the structure that the fibers have due to a step of manufacturing the recycled cellulose-based fibers from cellulose raw materials. In other words, it is known that in manufacturing recycled cellulose-based fibers, a material obtained by dissolving natural cellulose raw materials in carbon disulfide, a copper ammonia solution, or the like is subjected to spinning or the like, and in this process, the crystallinity of the natural cellulose thus deteriorates. It is considered that accordingly, the recycled cellulose-based fibers may exhibit swellability because moisture easily permeates between cellulose molecules configuring the fibers, and the cellulose molecules may be rearranged when the fibers swell, which may cause shrinkage after drying.

In order to address the above problems, various solutions have been proposed in the related art. For example, Patent Document 1 describes a method of providing a long-chain hydrocarbon-based compound on the surface of recycled cellulose fibers and the like to suppress the damage on fabrics resulting from washing or the like. Patent Document 2 describes a method of coating the surface of recycled cellulose fibers and the like with amino-modified silicone to enable washing in water. Patent Document 3 describes a method of using a predetermined crosslinking agent reacting with hydroxyl groups in cellulose molecules for recycled cellulose-based fibers, so as to form a crosslinking structure between cellulose molecules, to suppress the rearrangement of cellulose molecules in the fibers, and to suppress shrinkage or the like caused by washing in water or the like.

CITATION LIST

Patent Documents

[Patent Document 1]
Japanese Unexamined Patent Application, First Publication No. 2011-6808
[Patent Document 2]
Japanese Unexamined Patent Application, First Publication No. 2012-1830
[Patent Document 3]
Japanese Unexamined Patent Application, First Publication No. 2005-113333
[Patent Document 4]
Japanese Unexamined Patent Application, First Publication No. 2008-1728

SUMMARY OF INVENTION

Technical Problem

An object of the present invention is to improve the problems of the aforementioned recycled cellulose-based fibers and to provide a novel processing method for achieving dimensional stabilization by reducing shrinkage of a woven or knitted fabric containing particularly recycled cellulose-based fibers after washing in water or the like. Another object of the present invention is to provide recycled cellulose-based fibers processed by the method and a woven or knitted fabric containing the recycled cellulose-based fibers.

Solution to Problem

In order to achieve the above objects, the present invention provides the following means.

(1) Recycled cellulose fibers including an adsorbate on a surface thereof, in which the adsorbate contains cellulose nanofibers.
(2) The recycled cellulose fibers in which a weight ratio of the cellulose nanofibers is 0.01 wt % or more.
(3) The recycled cellulose fibers in which the adsorbate further contains a resin.
(4) A woven or knitted fabric including the recycled cellulose fibers.
(5) An anti-shrink processing method for recycled cellulose fibers, including a cellulose nanofiber adsorption step of immersing recycled cellulose fibers in a cellulose nanofiber dispersion in which cellulose nanofibers are dispersed such that the cellulose nanofibers are adsorbed onto the recycled cellulose fibers, and a drying step of drying the recycled cellulose fibers onto which the cellulose nanofibers are adsorbed.

(6) The anti-shrink processing method for recycled cellulose fibers, in which the cellulose nanofiber dispersion contains a resin component.

(7) The anti-shrink processing method for recycled cellulose fibers, further including, after the drying step, a resin adsorption step of immersing the recycled cellulose fibers in a solution containing a resin component.

(8) The anti-shrink processing method for recycled cellulose fibers, in which the recycled cellulose fibers are processed into a woven or knitted fabric.

Advantageous Effects of Invention

According to the present invention, it is possible to dimensionally stabilize recycled cellulose fibers and to reduce shrinkage of recycled cellulose fibers or a woven or knitted fabric containing recycled cellulose fibers after the recycled cellulose fibers or the woven or knitted fabric is washed in water.

DESCRIPTION OF EMBODIMENTS

Figure 1A:
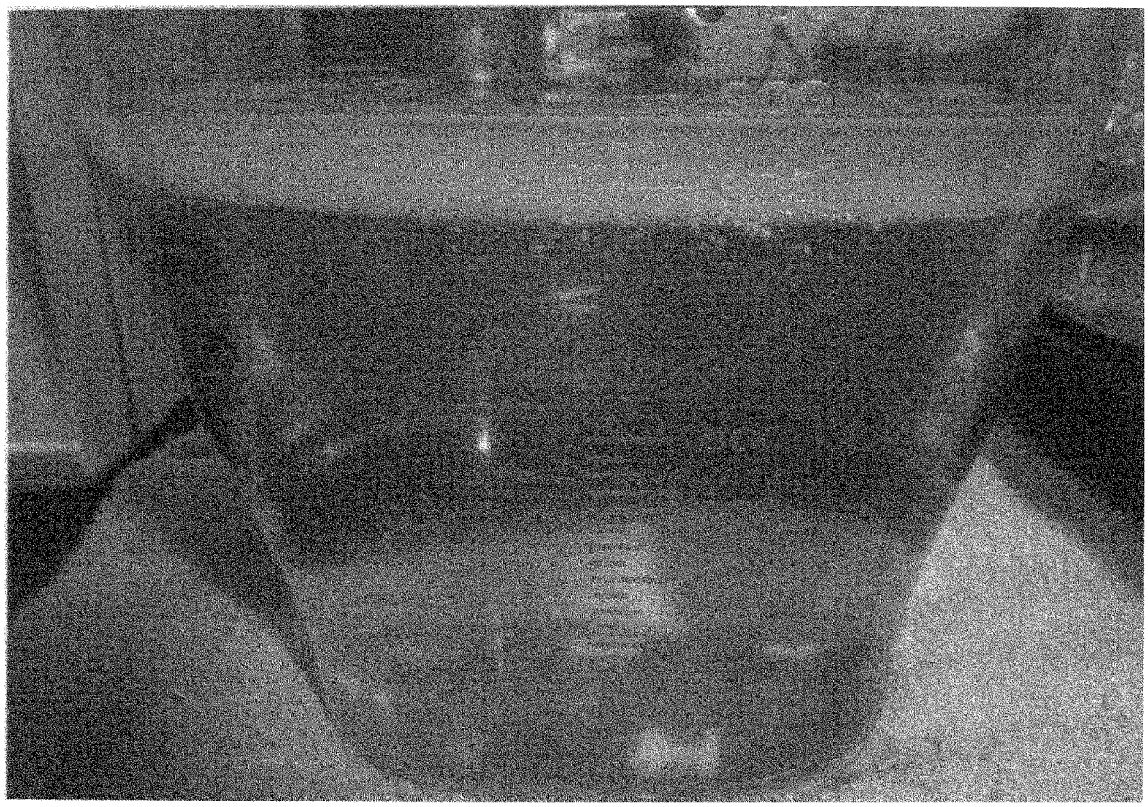
FIG. 1A is a photograph showing an example of a state where CNF is precipitated from a CNF dispersion.

As fibers to which the present invention is to be applied, so-called recycled cellulose fibers are desirable. In the present invention, recycled cellulose refers to cellulose and cellulose derivatives having higher hygroscopicity compared to natural cellulose, and also includes hydrated cellulose (cellulose II) that is obtained by a process of dissolving natural cellulose (cellulose I) in a predetermined solvent such as carbon disulfide or a copper ammonia solution and then inducing reprecipitation or cellulose derivatives that are obtained by carrying out a certain chemical modification in this process. Furthermore, hydrated cellulose obtained by processing natural cellulose with an alkali or the like is also included in the recycled cellulose, even though the hydrated cellulose is not cellulose obtained by dissolving natural cellulose.

Examples of the recycled cellulose include rayon, polynosic, cupra, lyocell, fortisan, mercerized cotton, acetate, and the like. Furthermore, in the present invention, recycled cellulose fibers mean unprocessed fibers that are obtained by performing spinning or the like on raw materials of the aforementioned recycled cellulose and fibers that are obtained by twisting only the unprocessed fibers or spinning the unprocessed fibers together with fibers formed of other raw materials. In addition, in the present invention, a woven or knitted fabric means materials in the form of cloth, such as a fabric, a knitted material, and non-woven fabric, and molded articles obtained by sewing the cloth.

The present invention is widely applicable to recycled cellulose fibers and a woven or knitted fabric containing the recycled cellulose fibers. Performing the processing according to the present invention makes it possible to inhibit the woven or knitted fabric from shrinking when washed in water or the like and to suppress the occurrence of "wrinkling" in a woven or knitted fabric resulting from partial shrinkage or the like of recycled cellulose fibers. In a case where the term "recycled cellulose fibers and the like" is mentioned in the present specification, the term means the aforementioned recycled cellulose fibers and a woven or knitted fabric containing the recycled cellulose fibers.

Among recycled cellulose fibers and the like, particularly recycled cellulose fibers and the like containing a recycled cellulose component at a ratio of 1 wt % or more with respect to the total weight of the fibers can bring about marked effects, in a case where the recycled cellulose fibers are processed by the anti-shrink processing method according to the present invention. Furthermore, in a case where recycled cellulose fibers and the like containing a recycled cellulose component at a ratio of 10 wt % or more, 30 wt % or more, or 50 wt % or more or fibers or a woven or knitted fabric containing a recycled cellulose component at 70 wt % or more or 90 wt % or more and thus substantially configured with recycled cellulose is processed by the processing method according to the present invention, swelling of the recycled cellulose fibers that occurs when the recycled cellulose fibers are wet with water due to washing in water or the like is mitigated, which makes it possible to effectively mitigate shrinkage that occurs when the recycled cellulose fibers are dried thereafter.

The recycled cellulose fibers according to the present invention and the woven or knitted fabric containing the recycled cellulose fibers are characterized in that an adsorbate containing cellulose nanofibers (hereinafter, described as "CNF" in some cases) is adsorbed onto the surface of the fibers.

The aforementioned CNF is a generic term for fine cellulose fibers obtained by extracting cellulose microfibrils, which are bundles of high crystalline cellulose molecules contained in plant cell walls and the like, by various processing methods (for example, see Patent Document 4 and the like). CNF is a fibrous substance that typically has an average fiber diameter of about 2 to 150 nm and an aspect ratio (fiber length/fiber diameter) of about 100 to 10,000, and is extremely finer than unprocessed fibers (with a diameter of about 10 μm) of recycled cellulose. Furthermore, CNF is strong fibrous cellulose that is said to have strength equal to or higher than strength of steel per unit cross-sectional area.

The mechanism through which the dimensional stability of the recycled cellulose fibers and the like according to the present invention is further improved compared to the dimensional stability of unprocessed recycled cellulose fibers is unclear. Meanwhile, as shown in Examples, it has been observed that the recycled cellulose fibers processed by the anti-shrink processing method according to the present invention have a structure where fine fibrous CNF or CNF aggregates as fibrous assemblies of the CNF are adsorbed onto the recycled cellulose fibers. Therefore, presumably, due to the strong CNF that is entangled with and adsorbed onto the recycled cellulose fibers, the recycled cellulose fibers may be physically restrained and inhibited from going through the increase of fiber diameter and the like when absorbing water and thus swelling, which may lead to the improvement of swelling resistance. Furthermore, it is considered that the physical restraint induced by the CNF may prevent the rearrangement of cellulose molecules in the recycled cellulose fibers, which may suppress shrinkage after drying.

In the present invention, any CNF can be used without particular limitation regardless of the manufacturing method or the like of CNF obtained from cellulose raw materials, as long as the CNF can be dispersed in a dispersion medium such as an aqueous solution or the like. For example, it is possible to use CNF that is manufactured by mechanically defibrating cellulose fibers or manufactured by performing acid hydrolysis or alkali processing on cellulose fibers and is on the market in the form of powder, aqueous dispersion, or the like, and to use a dispersion containing the CNF at a proper concentration as a processing liquid.

It is considered that as a result of adsorption of CNF onto the recycled cellulose fibers by the anti-shrink processing method according to the present invention, the CNF may restrict volume increase of the recycled cellulose fibers caused by water absorption and suppress swelling of the recycled cellulose fibers. Even though a small amount of CNF is adsorbed onto the recycled cellulose fibers, the effect according to the present invention can be produced. On the other hand, in a case where CNF at a ratio of 0.01 wt % or more based on the recycled cellulose fibers is adsorbed onto and coating the surface of the fibers, the interval between CNFs on the surface of the recycled cellulose fibers is reduced, which makes it possible to effectively inhibit the recycled cellulose fibers from swelling when wet with water. Causing CNF to be adsorbed onto and coat the fibers at a ratio of 0.05 wt % or 0.1 wt % or more makes it possible to markedly improve swellability of the fibers. Furthermore, causing CNF at a ratio of 0.5 wt % or 1.0 wt % or more to be adsorbed onto the recycled cellulose fibers makes it possible to coat substantially the entire surface of the recycled cellulose fibers with CNF.

In view of improving swellability of the fibers, there is no upper limit on the amount of CNF to coat the fibers. However, in a case where an excess of CNF is adsorbed onto and coats the recycled cellulose fibers, so-called "paperization" which is deterioration of flexibility of fibers tends to occur. Therefore, in view of maintaining the texture of the recycled cellulose fibers to be coated with CNF, it is desirable that the amount of CNF to be adsorbed onto the fibers be 5 wt % or less based on the fibers.

Considering that the generally used unprocessed recycled cellulose fibers have a diameter of about 10 μm, for example, in a case where the fibers are coated with CNF at about 0.1 wt % with respect to the fibers, the average thickness of the CNF coating layer is estimated to be about 2.5 nm. Because this is a value less than the generally known diameter of CNF, CNF in the aforementioned amount is considered to be randomly adsorbed onto the fibers at predetermined intervals instead of covering the entire surface of the recycled cellulose fibers. That is, the surface of fibers processed by the method according to the present invention does not need to be fully covered with CNF, and it is possible to improve swellability by causing CNF to be adsorbed onto the surface of fibers at such a density that volume increase by swelling can be suppressed when the fibers are wet with water.

Specifically, the swellability of the recycled cellulose fibers can be effectively improved in a case where CNF is adsorbed onto and coats 10% or more of the area of the surface of the fibers, and can be markedly effectively improved in a case where CNF is adsorbed onto 30% or more or 50% or more of the area of the surface of the fibers. Furthermore, even in an aspect in which substantially the entire surface of the recycled cellulose fibers is covered with CNF and the entire surface of the recycled cellulose fibers is covered with multi-layered CNF, the swellability can also be markedly effectively improved. The CNF adsorbed onto the surface of the recycled cellulose fibers can be observed, for example, with a scanning electron microscope or the like, and the coverage or the like of the recycled cellulose fibers can be evaluated.

The CNF adsorption processing to be performed on the recycled cellulose fibers can be carried out by performing a CNF adsorption step of immersing recycled cellulose fibers and the like in a CNF dispersion in which CNF is dispersed at a proper ratio such that the recycled cellulose fibers and the like are impregnated with CNF and CNF is adsorbed onto the recycled cellulose fibers and the like and then performing a drying step of drying the recycled cellulose fibers and the like. After the drying step, a setting processing (shape stabilizing processing) can be performed at about 150° C. to 200° C. in a state where the recycled cellulose fibers and the like maintain a predetermined shape, such that the recycled cellulose fibers and the like with CNF adsorbed onto the surface thereof have the initial shape.

In the aforementioned processing for CNF adsorption onto the recycled cellulose fibers and the like, for example, CNF may be adsorbed onto the single fiber of the recycled cellulose fibers that are not yet being subjected to spinning, recycled cellulose fibers that have undergone scouring or bleaching, or a woven or knitted fabric that is obtained using the fibers.

The processing method according to the present invention is a method of immersing recycled cellulose fibers and the like in a dispersion in which CNF is dispersed, such that the recycled cellulose fibers and the like are impregnated with CNF or CNF is adsorbed onto the recycled cellulose fibers and the like. This method is similar to a dyeing step of fiber products. Therefore, this method can be performed as a part of a step such as dyeing performed on a fiber material or a woven or knitted fabric. That is, unless the effect according to the present invention is impaired, CNF may be adsorbed onto a fiber material or a woven or knitted fabric in the dyeing step before or after the fiber material or the woven or knitted fabric is dyed, or may be mixed with a pigment and the like and adsorbed onto recycled cellulose fibers and the like while dyeing is being carried out.

A processing using a resin that is performed to give various properties to the recycled cellulose fibers and the like can be carried out in combination with the processing using CNF according to the present invention. That is, the processing using CNF according to the present invention can be combined in various ways with a processing using a resin, such as performing a resin processing on the recycled cellulose fibers and the like having undergone the CNF processing according to the present invention, simultaneously performing the CNF processing and a resin processing by using a processing liquid obtained by mixing a CNF-containing dispersion with a resin component and the like, and performing the CNF processing according to the present invention on recycled cellulose fibers and the like having undergone a resin processing.

As means for causing CNF to be adsorbed onto the recycled cellulose fibers and the like, for example, it is possible to appropriately use means classified as so-called dip dyeing which is a method of immersing fibers in a bath in which a pigment is dissolved such that the pigment is taken up by the fibers. Using a CNF dispersion as the aforementioned bath makes it possible to easily perform CNF adsorption. For example, with a dip dyeing and high-pressure processing in which recycled cellulose fibers and the like immersed in a CNF-containing dispersion are sealed in a container as they are, heated to about 120° C., and kept at high temperature and high pressure, it is possible to efficiently cause CNF contained in the dispersion to be adsorbed onto the recycled cellulose fibers and the like.

Furthermore, during a padding processing step or the like that is performed as a finishing step after dyeing of a woven or knitted fabric containing recycled cellulose fibers, the woven or knitted fabric containing the recycled cellulose fibers may be immersed in a CNF-containing processing liquid such that CNF is adsorbed onto the woven or knitted fabric, and then steps of dehydration by a roll, drying, heat processing (curing), and the like may be performed such that CNF is adsorbed onto the recycled cellulose fibers and the like.

Simply by performing a drying or heat processing after CNF is adsorbed onto the surface of the fibers by the immersion of recycled cellulose fibers and the like in a CNF dispersion, it is also possible to cause CNF to be adsorbed onto the surface of the recycled cellulose fibers and to bring about an anti-shrink effect. Furthermore, a spray method, a coating method, a printing method, or the like can also be used to cause CNF to be adsorbed onto the surface of the recycled cellulose fibers.

Particularly, performing a CNF adsorption processing on the woven or knitted fabric containing the recycled cellulose fibers is expected to cause CNF to be also adsorbed onto sites where the fibers intersect with each other in the woven or knitted fabric and to suppress deviation caused between the fibers, which can more effectively bring about the anti-shrink effect.

As a dispersion medium in which CNF is to be dispersed in the processing method according to the present invention, any dispersion medium can be appropriately used as long as the dispersion medium does not especially damage the recycled cellulose fibers and the like to be processed. As a CNF dispersion, a CNF-containing aqueous solution obtained by dispersing CNF in an aqueous solution is commercially available. The processing according to the present invention can be performed using a CNF aqueous dispersion obtained by means of appropriately diluting the CNF-containing aqueous solution and the like. Meanwhile, for example, it is preferable to use an organic solvent that is generally used for dry cleaning or the like and less harsh with the recycled cellulose fibers and the like and to perform the processing according to the present invention by using a dispersion obtained by dispersing CNF in such a solvent, because then it is possible to prevent the recycled cellulose fibers and the like from swelling during the processing by being wet with water.

In the processing method according to the present invention, it is desirable that the amount (concentration) of CNF in the CNF dispersion used be determined in consideration of the amount of CNF to be adsorbed onto the recycled cellulose fibers and the like after the processing.

In a case where CNF is adsorbed onto the recycled cellulose fibers and the like by the aforementioned dip dyeing processing, substantially the entirety of CNF in the CNF dispersion can be adsorbed onto the recycled cellulose fibers and the like. Therefore, it is possible to use a processing liquid in which CNF is dispersed in an amount corresponding to the amount of the recycled cellulose fibers and the like to be processed and the target amount of CNF to be adsorbed.

In a case where adsorption of CNF onto the recycled cellulose fibers and the like is performed by a padding processing or the like in which the recycled cellulose fibers and the like are immersed in a CNF-containing processing liquid under predetermined conditions and then dehydrated, it is desirable to determine the CNF concentration or the like in the processing liquid such that a desired amount of CNF is adsorbed onto the recycled cellulose fibers and the like after the processing.

For example, performing dip dyeing on the recycled cellulose fibers and the like in a processing liquid containing CNF at about 0.001% or more or performing a padding processing by using the processing liquid makes it possible to induce reduction of swellability of the recycled cellulose fibers and the like, reduction of shrinkage after washing in water, and the like.

It is considered that by the immersion of the recycled cellulose fibers and the like in the dispersion in which CNF is dispersed, CNF in contact with the recycled cellulose fibers and the like or a fibrous CNF assembly may be entangled with and attached to the surface of the fibers and the like. Furthermore, it is considered that CNF may be well adsorbed onto the surface of the recycled cellulose fibers, mainly because the recycled cellulose fibers and CNF have the same molecular structure. Presumably, the adsorption of CNF having high strength may then inhibit shape change of the recycled cellulose fibers resulting from swelling or the like. It is considered that as a result, shrinkage or the like at the time of washing in water or the like may be suppressed.

In the anti-shrink processing for the recycled cellulose fibers and the like according to the present invention, depending on the purpose such as adding desired texture or water repellency to the recycled cellulose fibers and the like, the recycled cellulose fibers and the like onto which CNF is adsorbed can be further coated with a resin component as appropriate. It is also possible to perform a coating processing on the recycled cellulose fibers and the like by using CNF mixed in advance with a resin component and the like. Particularly, performing coating with a resin component and the like in addition to CNF adsorption makes it possible to improve tear strength of the woven or knitted fabric containing the recycled cellulose fibers.

Examples of the aforementioned resin component to be used include a resin component used mainly for the purpose of making the surface of the recycled cellulose fibers hydrophobic, such as a fluorine-based resin component and a paraffin wax-based resin component. Furthermore, it is preferable to use a glyoxal resin generally used for the purpose of preventing wrinkles and shrinkage of cellulose-based fibers, because the use of such a resin is expected to cause a crosslinking reaction between cellulose molecules contained in the fibers or CNF and further enhances the effect of the CNF processing according to the present invention.

Depending on the purpose such as facilitating the CNF adsorption processing, the CNF dispersion in which the recycled cellulose fibers and the like are immersed for the purpose of causing CNF adsorption can be used by being mixed with appropriate chemical agents and the like. For example, various dispersants can be used for the purpose of excellently dispersing CNF in the CNF dispersion. Examples of the dispersants include polymers that function as various surfactants, orange oil, and the like.

For the purpose of facilitating attachment of CNF to the recycled cellulose fibers, it is effective to adjust acidity of the CNF dispersion depending on the type of fibers to be modified. As chemical agents to be used for adjusting the acidity, it is possible to use sodium hydroxide, soda ash, or the like to make the CNF dispersion alkaline or to use oxalic acid, acetic acid, malic acid, or the like to make the CNF dispersion acidic.

Hereinafter, the present invention will be more specifically described using examples, but the present invention is not limited to the following examples.

EXAMPLES

Example 1

The cloth consisting of cupra (44T/24F 2330T/M) was processed by the following method such that CNF was adsorbed onto the surface of fibers configuring the cloth.

For the processing for causing CNF to be adsorbed onto the surface of fibers, a processing liquid was used which was obtained by mixing CNF-containing aqueous solution manufactured by DKS Co. Ltd. (RHEOCRYSTA I-25P., CNF content; 2.2 wt %., hereinafter, called "undiluted solution 1" in some cases) with a dispersant (manufactured by Meisei Chemical Works, Ltd., ALKOSOL GL) in an amount equivalent to 2 wt % of the undiluted solution 1 and then diluting the mixture with water for industrial use such that solids of CNF contained in the processing liquid (300 ml) used for each processing had the weight described in Table 1. As will be described below, because 10 g of the cloth is immersed in each processing liquid, the weight ratio of CNF to the cloth in each example equals the value shown in the right column in Table 1.

The processing was carried out by sealing the cloth (10 g) immersed in each processing liquid (300 ml) as it is in a container made of a metal, heating the cloth to 120° C., and keeping the cloth as it is for 30 minutes (dip dyeing and high-pressure processing). It is considered that the cloth may be kept under a pressure of about 2 atm during the processing. For "Comparative Example 1" in Table 1, the same processing as above in which the cloth was kept at 120° C. for 30 minutes was carried out, except that water for industrial use was used. Each cloth having undergone the above processing was then dried indoors. Thereafter, in a state of having taken shape, the cloth was set with hot air at 170° C. for about 60 seconds (shape stabilizing processing), and used for each of the following evaluations.

TABLE 1

| | Weight of CNF solids (g) | Weight ratio to cloth (%) |
|---|---|---|
| Comparative Example 1 | 0 | 0 |
| Example 1-1 | 0.011 | 0.11 |
| Example 1-2 | 0.015 | 0.15 |
| Example 1-3 | 0.022 | 0.22 |
| Example 1-4 | 0.044 | 0.44 |

In the aforementioned dip dyeing and high-pressure processing, the following evaluation was performed to check adsorptivity that CNF contained in the processing liquid exhibits when being adsorbed onto the surface of the fibers. The same processing liquid (900 ml) as the processing liquid used in Example 1-4 was prepared and subjected to an electrolytic treatment at 14 V for 30 minutes, such that CNF dispersed and dissolved in the processing liquid was precipitated. Furthermore, the processing liquid (900 ml) having been used for the adsorption processing for the cloth corresponding to Example 1-4 was also subjected to the electrolytic treatment, such that CNF remaining in the processing liquid was precipitated.

Figure 1B:
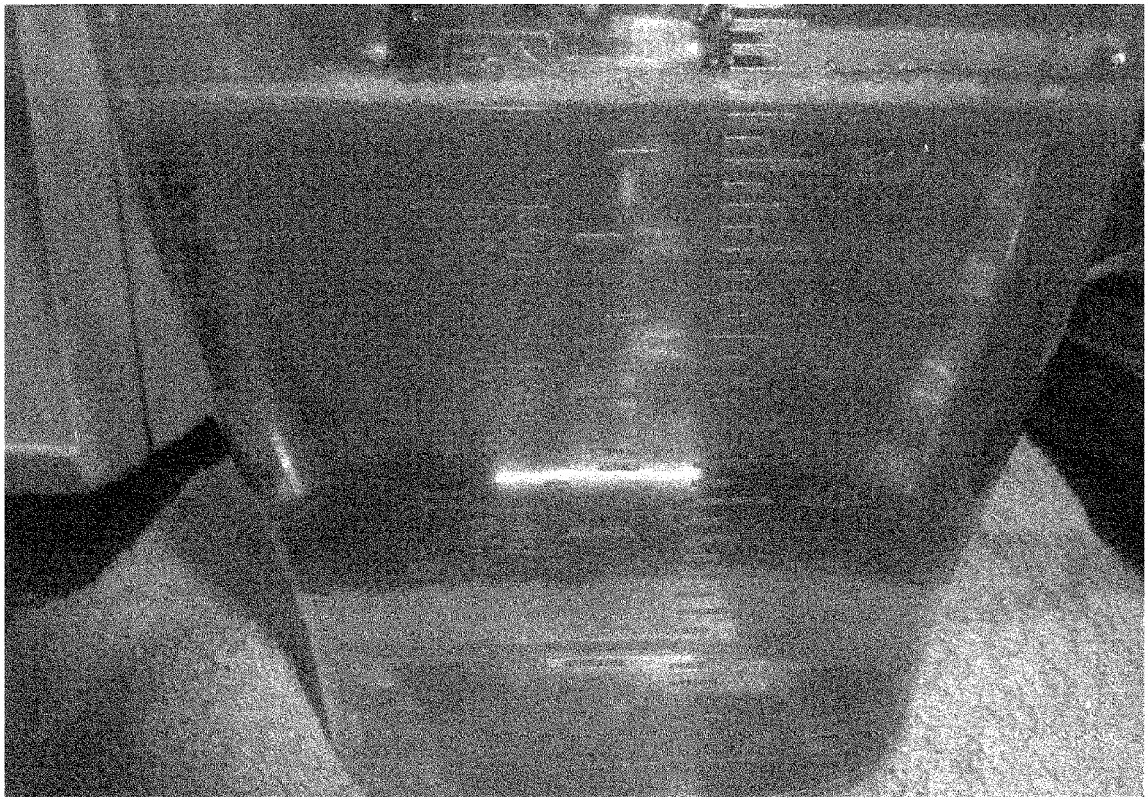
FIG. 1B is a photograph showing an example of a state where CNF is precipitated from a CNF dispersion after anti-shrink processing is performed on recycled cellulose fibers.

FIGS. 1A and 1B are photographs showing the state of CNF precipitated from the processing liquid before and after the processing described above. CNF precipitated by the above electrolytic treatment is observed as white turbidity on the upper part in each processing liquid. As shown in FIGS. 1A and 1B, the amount of CNF remaining in the processing liquid having been used for the processing (FIG. 1B) was smaller than the amount of CNF not yet being used for the processing (FIG. 1A), which tells that by the above processing, most of CNF contained in the processing liquid is removed from the processing liquid by being adsorbed onto the cloth or the like.

Figure 2A:
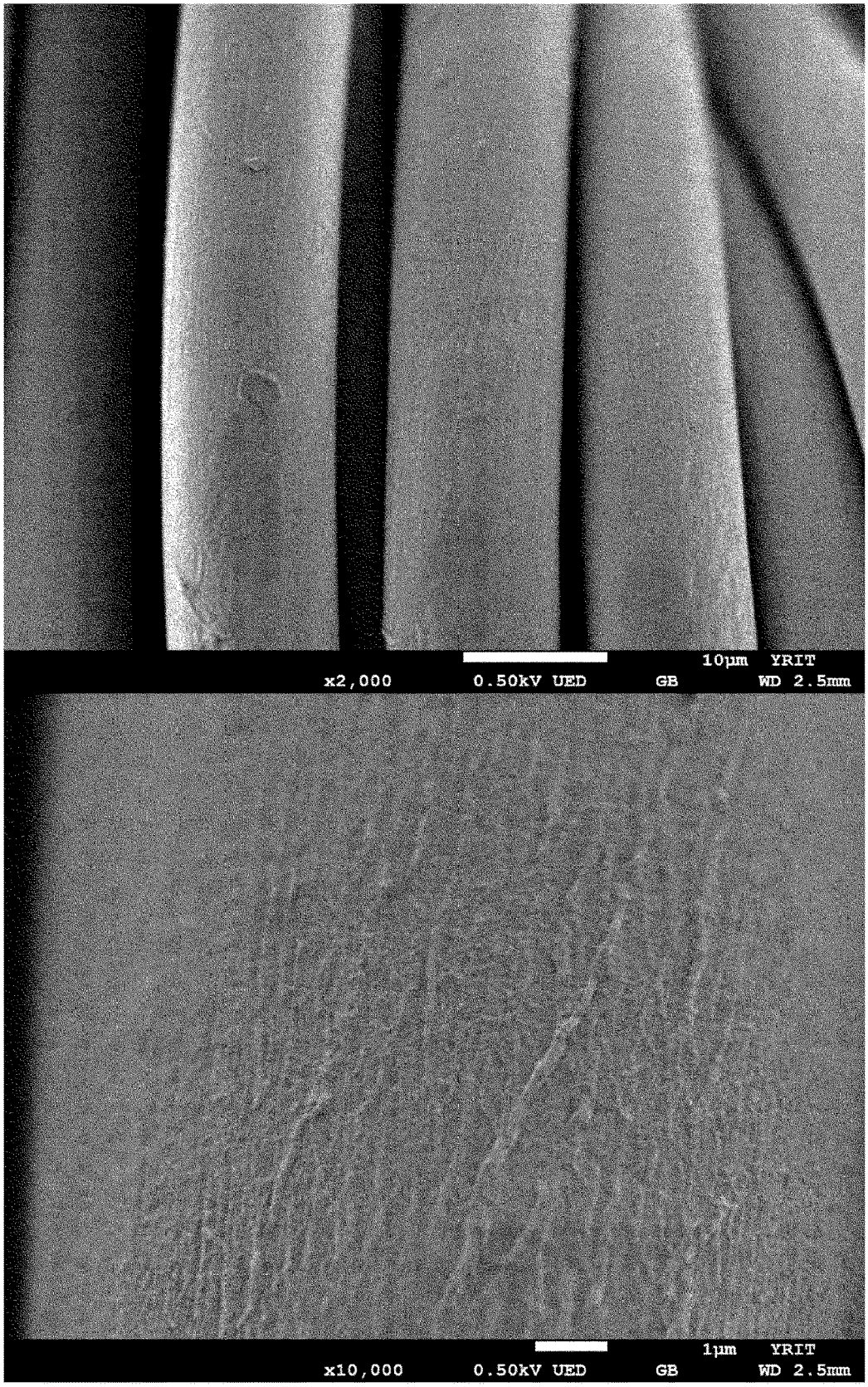
FIG. 2A is an SEM image of cupra fibers onto which CNF is adsorbed.
Figure 2B:
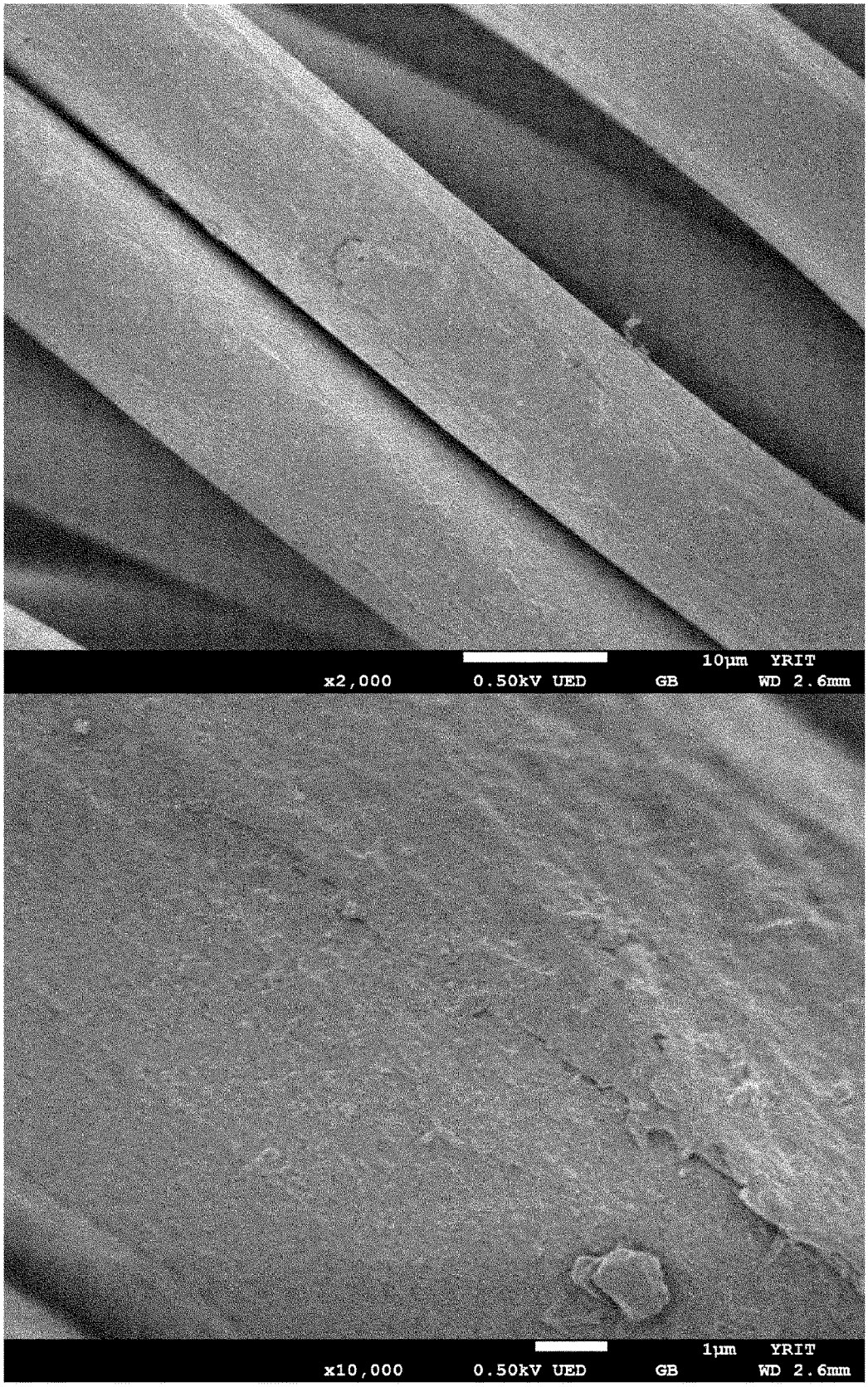
FIG. 2B is an SEM image of cupra fibers.

FIGS. 2A and 2B are SEM images of the surface of the fibers contained in the cloth before and after the above processing (Example 1-4). As shown in FIG. 2B, it has been observed that the surface of the fibers of the cloth processed in water devoid of CNF maintains the characteristic surface properties formed in a case where cupra fibers are spun. In contrast, as shown in FIG. 2A, it has been observed that the surface of the fibers of the cloth processed in the processing liquid containing CNF has properties different from the surface properties of the aforementioned cupra fibers.

Regarding the surface properties of the fibers processed in the processing liquid containing CNF, it is understood that CNF contained in the processing liquid is randomly adsorbed onto and integrated with the surface of cupra fibers and forms a network-like film on the surface of the cupra fibers. Furthermore, presumably, the streaks observed as being parallel with the fibers may be wrinkles that are formed because the surface of the fibers onto which CNF is adsorbed fails to conform to the inside of the fibers when the fibers onto which CNF is adsorbed in wet conditions dry and go through volume contraction.

Considering that cupra and CNF both contain cellulose as the main component and have approximately the same density, for example, in a case where 0.1 to 0.5 wt % of CNF is uniformly adsorbed onto cupra, the radius of cupra fibers increases at a ratio of about 0.05% to 0.25%, and the increase corresponds to the average thickness of the CNF layer on the surface of the cupra fibers. The average thickness of the CNF layer formed in a case where 0.1 to 0.5 wt % of CNF is attached to the cupra fibers having a radius of about 5 μm as shown in FIGS. 2A and 2B is estimated to be 2.5 to 12.5 nm. Incidentally, the estimated average thickness is a value corresponding to the diameter (about 3 to 10 nm) of the used CNF. Therefore, presumably, CNF in the aforementioned amount may be adsorbed onto the surface of the recycled cellulose fibers at predetermined intervals, without being uniformly adsorbed onto the surface of the recycled cellulose fibers and forming a film.

That is, it is considered that in order to obtain the effect produced by causing CNF to be adsorbed onto the surface of the recycled cellulose fibers as below, it is not always necessary for CNF to be adsorbed onto the surface of the fibers without gaps and to form a film, and the adsorption of CNF to cover a part of the surface of the fibers can reduce the swelling of the fibers or the extent of shrinkage by drying after swelling.

Each cloth having undergone the aforementioned processing using CNF was moistened by being immersed in water by the following method and then dried, and the extent of shrinkage or the like that occurs in this process was evaluated. For the evaluation, each cloth in which markings (2 sites) were made at an interval of 10 cm was thoroughly wet by being immersed in water for industrial use for about 12 hours at room temperature, and then the interval between the markings was measured to evaluate the dimensional change of the moistened cloth. Then, each cloth was naturally dried indoors, and the interval between the markings was measured after drying to evaluate the dimensional change of the cloth after drying.

Table 2 shows the results of the above evaluation. In Table 2, each of the shrinkage of moistened cloth and shrinkage of the cloth after drying was expressed as a percentage obtained by dividing the interval between the markings in the moistened cloth and cloth after drying described above by 10 cm. "+(plus)" represents expansion, and "− (minus)" represents shrinkage. As shown in Table 2, it has been observed that compared to the cloth not being subjected to the CNF processing (Comparative Example 1), each cloth subjected to the aforementioned CNF processing less expands when moistened. Furthermore, regarding the dimensional change after drying of the moistened cloth, while apparent dimensional reduction was observed in the cloth (Comparative Example 1) not being subjected to the CNF processing, substantially no dimensional change was observed in the cloth subjected to the CNF processing according to the present invention.

TABLE 2

| | Shrinkage in moistened state (%) | Shrinkage after drying (%) |
|---|---|---|
| Comparative Example 1 | +3 | −3 |
| Example 1-1 | +2 | 0 |
| Example 1-2 | +2 | 0 |
| Example 1-3 | +2 | 0 |
| Example 1-4 | +2 | 0 |

By the method described below, the difference in swelling behavior between cupra fibers processed with the aforementioned CNF and cupra fibers not being processed with the aforementioned CNF was evaluated. In the evaluation, for cloth not being subjected to the CNF processing (Comparative Example 1) and cloth subjected to the CNF processing (Example 1-4), by using a polarizing microscope (ECLIPSE LOV100N POL manufactured by Nikon Corporation, transmission observation under crossed nicols), the diameter of cupra fibers was measured in a dry state and after 6 hours of immersion in water.

Table 3 shows the results of the above evaluation. As shown in Table 3, it has been revealed that while the cloth not being subjected to the CNF processing (Comparative Example 1) absorbs water and thus swells until the cross-sectional area of the fibers becomes about 150%, the cloth (Example 1-4) subjected to the CNF processing according to the present invention swells to an extent reduced to about 120%. Examples of the reason why the extent of swelling of the fibers is reduced as shown in Table 3 by performing the CNF processing include a phenomenon where the fibers are restrained by the strong CNF entangled with the surface of the fibers, which makes it difficult for the fibers to expand more than a certain degree even being wet with water.

TABLE 3

| | Dry state (μm) | Moistened state (μm) | Expansion rate of cross-sectional area (%) |
|---|---|---|---|
| Comparative Example 1 | 12.6 | 15.5 | 151 |
| Example 1-4 | 12.5 | 13.7 | 120 |

For each cloth having undergone the aforementioned processing using CNF, according to JIS L 1096 D method (pendulum method), the tear strength was measured in a dry state and a moistened state. Table 4 shows the measurement results of the tear strength. As shown in Table 4, in the cloth subjected to the CNF processing, substantially no change in tear strength was observed in both the dry state and the moistened state.

TABLE 4

| | Tear strength (N) | |
|---|---|---|
| | Dry state | Moistened state |
| Comparative Example 1 | 8.6 | 3.0 |
| Example 1-1 | 6.4 | 2.9 |
| Example 1-2 | 7.5 | 3.1 |
| Example 1-3 | 8.0 | 3.0 |
| Example 1-4 | 8.5 | 3.0 |

Example 2

The cloth consisting of cupra (84T/90F 1630T/M) was processed by the following method such that CNF was adsorbed onto the surface of fibers configuring the cloth.

For the processing for causing CNF to be adsorbed onto the surface of the fibers, a processing liquid was used which was obtained by mixing a CNF-containing aqueous solution (CELLENPIA, CNF content; 1.0 wt %, called "undiluted solution 2" in some cases) manufactured by NIPPON PAPER INDUSTRIES CO., LTD. with a dispersant (manufactured by Meisei Chemical Works, Ltd., ALKOSOL GL) in an amount equivalent to 2 wt % of the undiluted solution 2 and then diluting the mixture with water for industrial use such that the weight ratio of solids of CNF meets the conditions shown in Table 5. For "Comparative Example 2" in Table 5, water for industrial use was used as a processing liquid.

During the processing, the aforementioned cloth was immersed in each processing liquid by using a padding processing device, then squeezed with a roll to yield a wet pickup of 100% by weight, then dried, and then set with hot air at 170° C. for about 60 seconds (shape stabilizing processing). The obtained cloth was used for each of the following evaluations.

TABLE 5

| | Weight ratio of CNF in processing liquid (%) |
|---|---|
| Comparative Example 2 | 0 |
| Example 2-1 | 0.005 |
| Example 2-2 | 0.01 |
| Example 2-3 | 0.015 |
| Example 2-4 | 0.02 |
| Example 2-5 | 0.03 |

In the same manner as in Example 1, each cloth having undergone the aforementioned processing using CNF was moistened by being immersed in water and then dried, and the extent of shrinkage or the like that occurs in this process was evaluated. Table 6 shows the results of the above evaluation.

As shown in Table 6, it has been observed that while Comparative Example 2 markedly expands when moistened and markedly shrinks after drying, Examples 2-1 to 2-5 subjected to the processing using CNF is inhibited from undergoing dimensional change.

TABLE 6

| | Shrinkage in moistened state (%) | Shrinkage after drying (%) |
|---|---|---|
| Comparative Example 2 | +6 | −7 |
| Example 2-1 | 0 | −2 |
| Example 2-2 | 0 | −2 |
| Example 2-3 | 0 | −1 |
| Example 2-4 | 0 | −1 |
| Example 2-5 | 0 | 0 |

In the same manner as in Example 1, the difference in swelling behavior between cupra fibers processed with the aforementioned CNF and cupra fibers not being processed with the aforementioned CNF was evaluated. Table 7 shows the results of the above evaluation. As shown in Table 7, it has been revealed that while the cloth not being subjected to the CNF processing (Comparative Example 2) absorbs water and thus swells until the cross-sectional area of the fibers becomes about 170%, the cloth (Example 2-5) subjected to the CNF processing according to the present invention swells to an extent reduced to about 116%.

TABLE 7

| | Dry state (μm) | Moistened state (μm) | Expansion rate of cross-sectional area (%) |
|---|---|---|---|
| Comparative Example 2 | 8.9 | 11.6 | 170 |
| Example 2-5 | 9.0 | 10.4 | 116 |

For each cloth having undergone the aforementioned processing using CNF, in the same manner as in Example 1, tear strength was measured in a dry state and a moistened state. Table 8 shows the measurement results of the tear strength. As shown in Table 8, in the cloth subjected to the CNF processing, substantially no change in tear strength was observed in both the dry state and the moistened state.

TABLE 8

| | Tear strength (N) | |
|---|---|---|
| | Dry state | Moistened state |
| Comparative Example 2 | 13.4 | 6.1 |
| Example 2-1 | 15.1 | 6.8 |
| Example 2-2 | 14.2 | 6.4 |
| Example 2-3 | 13.2 | 5.3 |
| Example 2-4 | 19.4 | 5.8 |
| Example 2-5 | 15.2 | 7.1 |

Example 3

By the following method, cloth (proportion of polyester: about 35%) obtained by interweaving Bemberg (120 denier) with polyester yarn (100 denier) lengthwise and breadthwise in a lattice pattern was processed such that the surface of fibers configuring the cloth was coated with CNF mixed in advance with a resin component. While Bemberg is recycled cellulose fibers that tend to shrink when washed in water or the like, polyester is synthetic fibers that substantially do not shrink when washed in water or the like.

As a processing liquid, a liquid was used which was obtained by mixing together the undiluted solution 2 used in Example 2 as a CNF source, glyoxal resins (BECKAMINE N-80 and BECKAMINE M-3 manufactured by DIC CORPORATION) as resin components, a catalyst (manufactured by DIC CORPORATION, CATALYST 376), a dispersant (manufactured by Meisei Chemical Works, Ltd., PETROX P-200), and water for industrial use such that these components had the ratio shown in Table 9. The aforementioned cloth was immersed in the processing liquid by using a padding processing device, and then squeezed with a roll to yield a wet pickup of 100% by weight, and then dried. Thereafter, in a state of having taken a shape, the cloth was set with hot air at 170° C. for about 60 seconds, and used for evaluation. For the evaluation, each of the cloth processed as above and unprocessed cloth was subjected to a hand-washing test at 40° C., boiled at 100° C. for 10 minutes (boil test), and then dried, and the shrinkage rate after drying was evaluated.

TABLE 9

| | Weight ratio of processing liquid component |
|---|---|
| Undiluted solution 2 | 2.0% (as CNF, 0.02%) |
| N-80 | 5.0% |
| M-3 | 1.0% |
| Catalyst | 0.5% |
| PETROX | 0.5% |

Table 10 shows the shrinkage rate after the hand-washing test and boil test described above. The shrinkage rate was calculated by measuring the distance between markings provided in advance at an interval of 10 cm. As shown in Table 10, while the unprocessed cloth shrank about 5% by hand washing and shrank about 10% by the boil test, the cloth having undergone the CNF processing was markedly inhibited from shrinking. It has been observed that in the unprocessed cloth having a high shrinkage rate, the polyester yarns that substantially do not shrink rise up from the cloth and cause wrinkles.

TABLE 10

| | Hand-washing test | | Boil test | |
|---|---|---|---|---|
| | Warp direction | Weft direction | Warp direction | Weft direction |
| Unprocessed | 5.6% | 4.5% | 11.3% | 8.0% |
| After processing | 0.9% | 0.5% | 3.2% | 1.6% |

Example 4

For cloth consisting of cupra (warp: 56T/60 2000S, weft: 84T90 1630SZ), by the following method, tear strength was tested after the cloth was subjected to the following processing for causing CNF adsorbed onto the surface of fibers configuring the cloth and after the cloth was subjected to a resin processing in addition to the above processing.

CNF adsorption processing: under the same conditions as in Example 1-1, the cloth was subjected to a dip dyeing and high-pressure processing for coating the cloth with CNF, then dried, and set with hot air at 170° C. for about 60 seconds (Example 4-1).

Resin processing treatment: the cloth (Example 4-1) having undergone the aforementioned CNF adsorption processing was additionally subjected to a padding processing using a processing liquid containing glyoxal resins (manufactured by DIC CORPORATION, BECKAMINE N-80; 1 wt %, BECKAMINE M-3; 1 wt %), a catalyst (manufactured by DIC CORPORATION, CATALYST 376; 0.5 wt %), and 0.5 wt % of CNF derived from the undiluted solution 1, squeezed with a roll to yield a wet pickup of 100% by weight, dried, and then subjected to the same setting processing as above (Example 4-2).

Table 11 shows the tear strength (dry state) of Examples 4-1 and 4-2 measured by the same method as in Example 1, in comparison with the unprocessed cloth (Comparative Example 4). As shown in Table 11, it has been observed that additionally performing resin processing on the cloth having undergone the CNF adsorption processing improves the tear strength.

TABLE 11

| | Tear strength (N) | |
|---|---|---|
| | Warp | Weft |
| Comparative Example 4 | 8.8 | 10.4 |
| Example 4-1 | 13.1 | 17.2 |
| Example 4-2 | 24.8 | 23.5 |

Example 5

In order to verify the difference between the effect obtained in a case where a dip dyeing and high-pressure processing is used as means for causing CNF to be adsorbed onto cloth (fibers) by using CNF mixed in advance with a resin component and the effect obtained in a case where a padding processing is used as the same means, by the following method, an examination was performed using cloth (TANAKA SHOKAI TNK-471-A) composed of warp: diacetate (AC: 75d S800T/M) a weft: cupra (Cu: SB 60/-) at a mixing ratio of AC70%/Cu30%.

In the dip dyeing and high-pressure processing, a processing liquid was used which was obtained by mixing the undiluted solution 1 used in Example 1 as a CNF source with glyoxal resins (BECKAMINE N-80 and BECKAMINE M-3 manufactured by DIC CORPORATION) as resin components and a catalyst (manufactured by DIC CORPORATION, CATALYST 376) at the ratio shown in Table 12 and adding 300 ml of water for industrial use to the mixture. The processing was carried out by sealing the cloth (10 g) immersed in the processing liquid (300 ml) as it is in a container made of a metal, heating the cloth to 100° C., and keeping the cloth as it is for 20 minutes (dip dyeing and high-pressure processing). The cloth having undergone the processing was dried at room temperature, and then set with hot air at 170° C. for 60 seconds (Example 5-1). For comparison, a sample was prepared which was processed in the same manner as above except that water for industrial use was used as a processing liquid (Comparative Example 5).

TABLE 12

| | Weight ratio to cloth |
|---|---|
| Undiluted solution 1 | 10% (as CNF, 0.22%) |
| N-80 | 5% |
| M-3 | 1% |
| Catalyst | 0.5% |

A padding processing was performed using a processing liquid which was obtained by mixing together the undiluted solution 1 used in Example 1 as a CNF source, glyoxal resins (BECKAMINE N-80 and BECKAMINE M-3 manufactured by DIC CORPORATION), a catalyst component (manufactured by DIC CORPORATION, CATALYST 376), and water for industrial use such that these components had the ratio shown in Table 13. In order to exclude the influence of the hydrothermal treatment in Example 5-1 on the fibers, the cloth obtained as a sample in Comparative Example 5 was subjected to the padding processing (Example 5-2).

TABLE 13

| | Weight ratio of processing liquid component |
|---|---|
| Undiluted solution 1 | 0.5% (as CNF, 0.011%) |
| N-80 | 1% |
| M-3 | 1% |
| Catalyst | 0.5% |

Table 14 shows the results of measuring the tear strength of Examples 5-1 and 5-2 and Comparative Example 5 in the same manner as in Example 1 in a dry state. As shown in Table 14, in terms of tear strength after processing, it has been revealed that the tear strength improving effect is high in a case where the CNF processing is performed by the padding processing. Presumably, this result may be obtained because the way the CNF is adsorbed onto the fibers or the condition or the like of the resin varies with the processing method used for coating the fibers with CNF.

TABLE 14

| | Tear strength (N) | |
|---|---|---|
| | Warp (AC) | Weft (Cu) |
| Comparative Example 5 | 4.47 | 8.77 |
| Example 5-1 | 4.67 | 10.53 |
| Example 5-2 | 9.40 | 15.17 |

INDUSTRIAL APPLICABILITY

Causing CNF or the like to be adsorbed onto recycled cellulose fibers and the like by the present invention makes it possible to inhibit the recycled cellulose fibers and the like from shrinking when washed in water or the like.

What is claimed is:

1. An anti-shrink processing method for recycled cellulose fibers, the method comprising:

a cellulose nanofiber adsorption step of immersing recycled cellulose fibers in a cellulose nanofiber dispersion in which cellulose nanofibers are dispersed, such that the cellulose nanofibers are adsorbed onto the recycled cellulose fibers;

a drying step of drying the recycled cellulose fibers onto which the cellulose nanofibers are adsorbed; and a resin adsorption step of immersing the recycled cellulose fibers in a solution containing a resin component after the drying step.

2. The anti-shrink processing method for recycled cellulose fibers according to claim 1, wherein the cellulose nanofiber dispersion contains a resin component.

3. The anti-shrink processing method for recycled cellulose fibers according to claim 1, wherein the recycled cellulose fibers are processed into a woven or knitted fabric.

4. The anti-shrink processing method for recycled cellulose fibers according to claim 2, wherein the resin component comprises at least one of: a fluorine-based resin, a paraffin wax-based resin, or a glyoxal resin.

* * * * *